US008939795B2

(12) United States Patent
Tsuchiya et al.

(10) Patent No.: US 8,939,795 B2
(45) Date of Patent: Jan. 27, 2015

(54) SHIELD STRUCTURE OF CONDUCTOR CABLE AND ELECTRICALLY DRIVEN VEHICLE

(75) Inventors: Yukio Tsuchiya, Toyota (JP); Kentaro Haruno, Toyota (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 0 days.

(21) Appl. No.: 13/600,284

(22) Filed: Aug. 31, 2012

(65) Prior Publication Data

US 2013/0065405 A1 Mar. 14, 2013

(30) Foreign Application Priority Data

Sep. 9, 2011 (JP) ..... 2011-197450

(51) Int. Cl.
*H01R 13/658* (2011.01)
*H01R 13/6581* (2011.01)

(52) U.S. Cl.
CPC ..... *H01R 13/6581* (2013.01); *Y10S 439/901* (2013.01); *Y10S 439/904* (2013.01)
USPC ..... 439/607.56; 439/901; 439/904; 439/373

(58) Field of Classification Search
USPC ..... 439/373, 607.55, 607.56, 607.57, 904, 439/905, 906, 901
See application file for complete search history.

(56) References Cited

U.S. PATENT DOCUMENTS

| | | | | |
|---|---|---|---|---|
| 4,697,720 | A * | 10/1987 | Hotchkiss et al. | 174/138 F |
| 6,410,844 | B1 * | 6/2002 | Bruner et al. | 174/17 VA |
| 6,460,642 | B1 * | 10/2002 | Hirano | 180/65.1 |
| 7,029,315 | B2 * | 4/2006 | Dang | 439/468 |
| 7,128,614 | B1 * | 10/2006 | Wu | 439/638 |
| 7,465,196 | B2 * | 12/2008 | Duarte et al. | 439/607.41 |
| 7,497,691 | B2 * | 3/2009 | Urano | 439/34 |
| 7,645,157 | B2 * | 1/2010 | Mizutani et al. | 439/382 |
| 7,695,320 | B2 | 4/2010 | Tsukashima et al. | |
| 7,804,212 | B2 * | 9/2010 | Moody | 310/88 |
| 7,828,591 | B2 * | 11/2010 | Matsuoka | 439/559 |
| 8,096,825 | B2 * | 1/2012 | Roepke | 439/504 |
| 8,328,566 | B1 * | 12/2012 | Thibodeaux et al. | 439/149 |
| 2004/0065472 | A1 * | 4/2004 | Sekijima et al. | 174/250 |
| 2012/0238138 | A1 * | 9/2012 | Matsuoka et al. | 439/607.55 |
| 2013/0065405 | A1 * | 3/2013 | Tsuchiya et al. | 439/34 |
| 2014/0051282 | A1 * | 2/2014 | Tanaka et al. | 439/502 |

FOREIGN PATENT DOCUMENTS

| | | | |
|---|---|---|---|
| JP | 08-065944 | A | 3/1996 |
| JP | 2006-344398 | A | 12/2006 |
| JP | 2013-012457 | A | 1/2013 |

* cited by examiner

*Primary Examiner* — James Harvey
(74) *Attorney, Agent, or Firm* — Gifford, Krass, Sprinkle, Anderson & Citkowski, P.C.

(57) ABSTRACT

A shield structure of a conductor cable includes a first case that accommodates a rotating electrical machine, a first terminal block that is provided on the first case, a second case that accommodates an inverter, a second terminal block that is provided on the second case, a conductor cable that electrically connects the first terminal block and the second terminal block to each other, and a metal shell that is arranged across the first case and the second case and covers at least part of a periphery of the conductor cable.

4 Claims, 5 Drawing Sheets

SHIELD STRUCTURE OF CONDUCTOR CABLE AND ELECTRICALLY DRIVEN VEHICLE

INCORPORATION BY REFERENCE

The application claims priority to Japanese Patent Application No. 2011-197450 filed on Sep. 9, 2011, which is incorporated herein by reference in its entirety including the specification, drawings and abstract.

BACKGROUND OF THE INVENTION

1. Field of the Invention

The invention relates to a shield structure of a conductor cable, and an electrically driven vehicle that is equipped with the shield structure.

2. Description of Related Art

In a drive unit of an electrically driven vehicle such as an electric vehicle, a hybrid vehicle, or the like, a large current flows through a conductor cable that electrically connects a rotating electrical machine and an inverter to each other, so that a magnetic field is generated. Thus, a structure that shields such a magnetic field is necessitated. As a shield structure of a conductor cable, there is known a structure in which the periphery of the conductor cable is covered with a braided conductor, and an end of the conductor cable is caulked to be fixed to a region to which a box body is fastened (e.g., Japanese Patent Application Publication No. 2006-344398).

However, the structure employing the braided conductor has a problem in that the adoption thereof is difficult in terms of manufacture in the case where the conductor cable is short, for example, in the case where a rotating electrical machine and an inverter are arranged contiguous to each other, in addition to a problem of cost.

SUMMARY OF THE INVENTION

The invention provides a shield structure of a conductor cable that realizes good shield performance without employing a braided conductor, and an electrically driven vehicle that is equipped with the shield structure.

A shield structure of a conductor cable according to a first aspect of the invention includes a first case that accommodates a rotating electrical machine, a first terminal block that is provided on the first case, a second case that accommodates an inverter, a second terminal block that is provided on the second case, a conductor cable that electrically connects the first terminal block and the second terminal block to each other, and a metal shell that is arranged across the first case and the second case and covers at least part of a periphery of the conductor cable.

In the first aspect of the invention, at least two metal shells may be arranged across the first case and the second case in such a manner as to surround the periphery of the conductor cable.

In the first aspect of the invention, the metal shell may be arranged in such a manner as to cover at least one of the first terminal block and the second terminal block.

In the first aspect of the invention, the first terminal block and the second terminal block may have support portions that support the metal shell.

An electrically driven vehicle according to a second aspect of the invention includes a first case that accommodates a rotating electrical machine, a second case that accommodates an inverter, a first terminal block that is provided on the first case, a second terminal block that is provided on the second case, a conductor cable that electrically connects the first terminal block and the second terminal block to each other, and a metal shell that is arranged across the first case and the second case and covers at least part of a periphery of the conductor cable.

According to the aspects of the invention, good shield performance can be realized without employing a braided conductor. That is, in the shield structure according to the aspects of the invention, since the metal shell is arranged across the first case and the second case, a magnetic field generated from the conductor cable is unlikely to leak out. Further, the cost can be reduced, and the productivity can be enhanced in comparison with a structure employing a braided conductor. In particular, the shield structure according to the aspects of the invention is suited for cases where it is difficult to adopt a structure employing a braided conductor because of a short length of a conductor cable.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

A shield structure 20 of a conductor cable (which will be referred to hereinafter as "the shield structure 20") as the embodiments of the invention, and a hybrid vehicle 10 that is equipped with this shield structure 20 will be described in detail with reference to the drawings.

Figure 1:
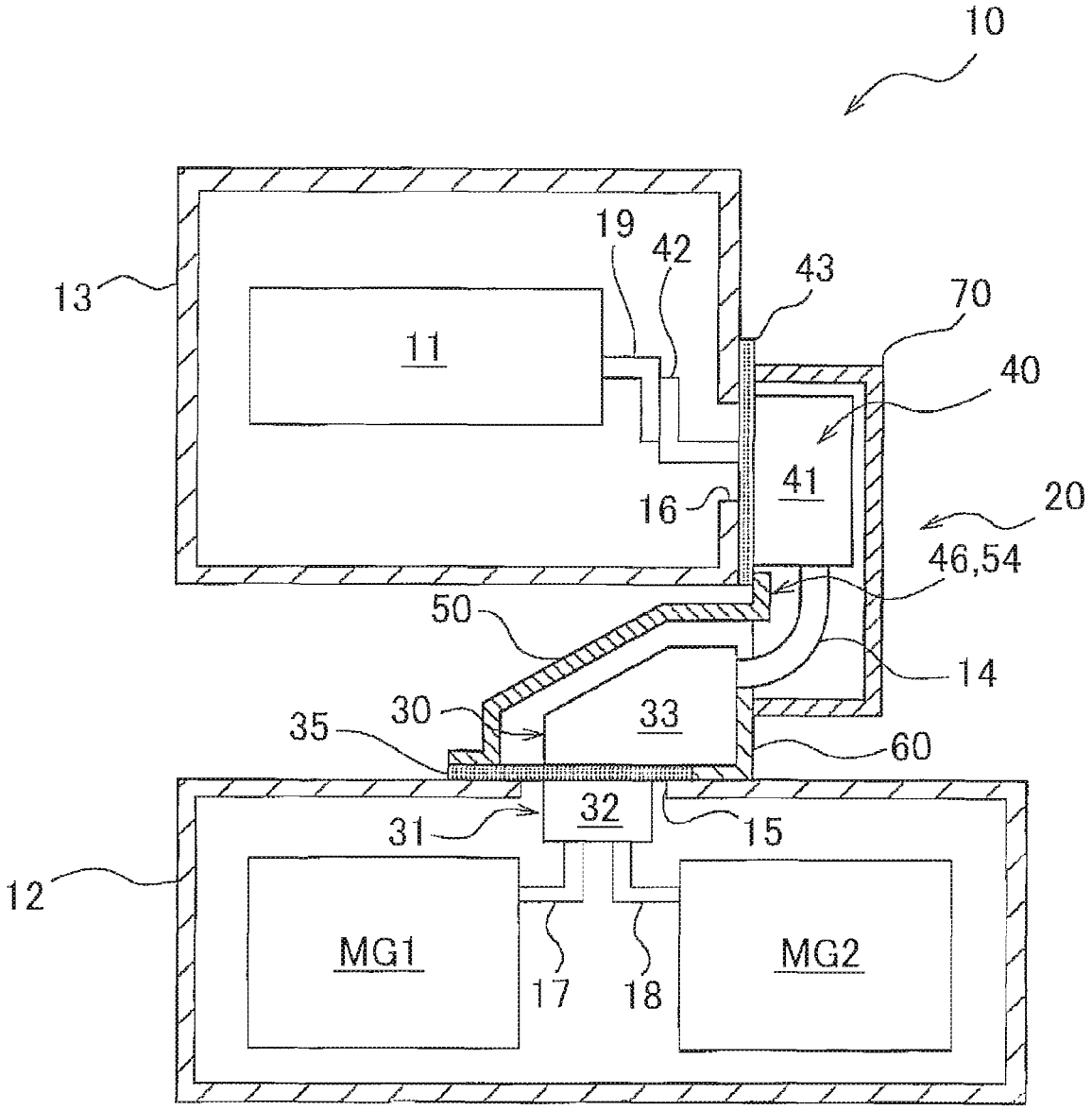
FIG. 1 is a view schematically showing a shield structure of a conductor cable as an embodiment of the invention, and an essential part of an electrically driven vehicle that is equipped with the shield structure.

Although the hybrid vehicle 10 is exemplified in the embodiments of the invention, the invention is not limited thereto, but is also applicable to an electrically driven vehicle that is not mounted with an engine. In the embodiments of the invention, for the convenience of explanation, terms representing directions, such as "vertical", "lateral", "longitudinal" and the like are used. In FIG. 1, the up-and-down direction on the sheet, the right-and-left direction on the sheet, and the direction perpendicular to the sheet are defined as "the vertical direction", "the lateral direction", and "the longitudinal direction (the space ahead of the sheet is located forward)" of the hybrid vehicle 10 and the shield structure 20, respectively.

Figure 2:
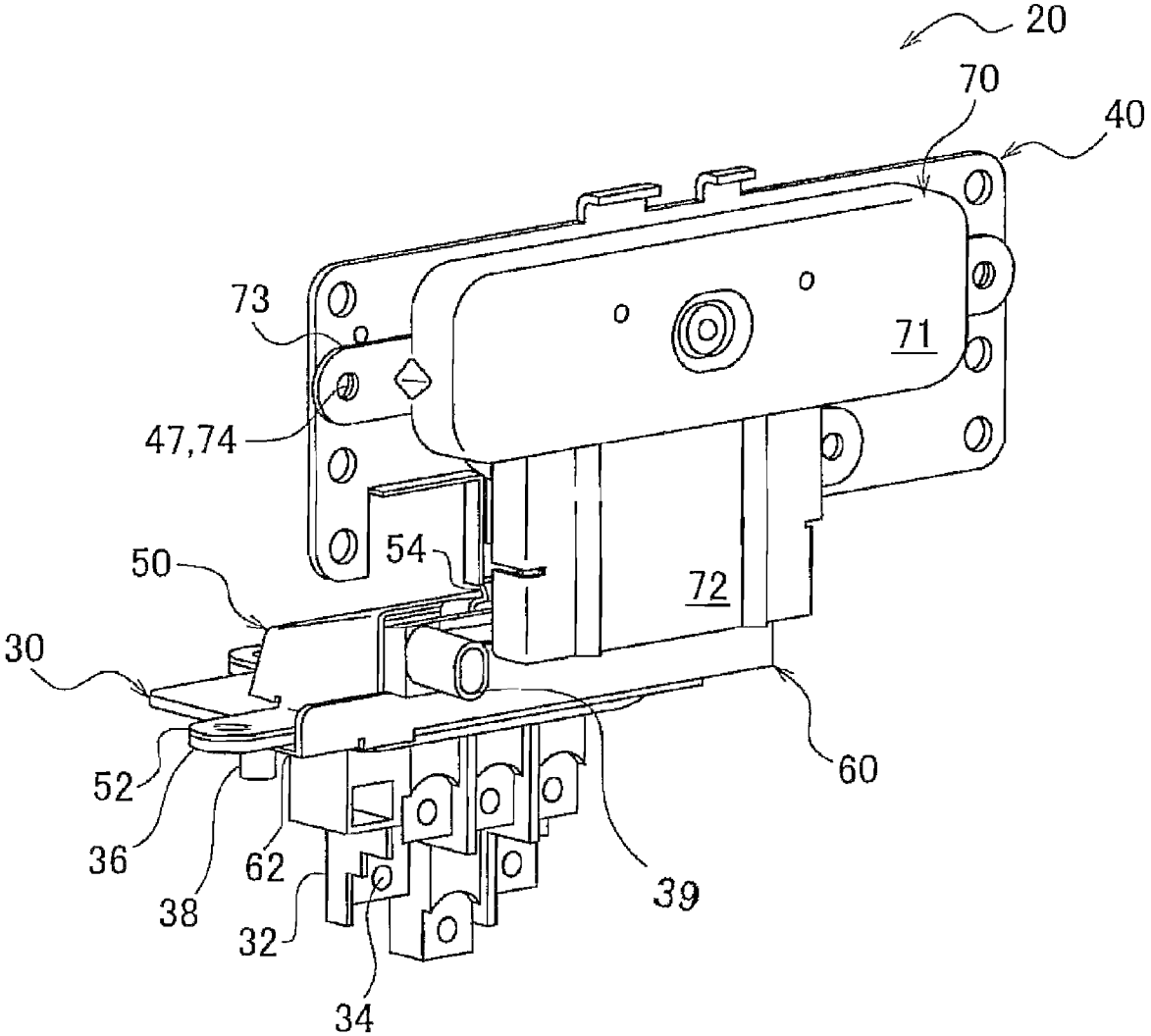
FIG. 2 is a perspective view showing the shield structure of the conductor cable as the embodiment of the invention.
Figure 3:
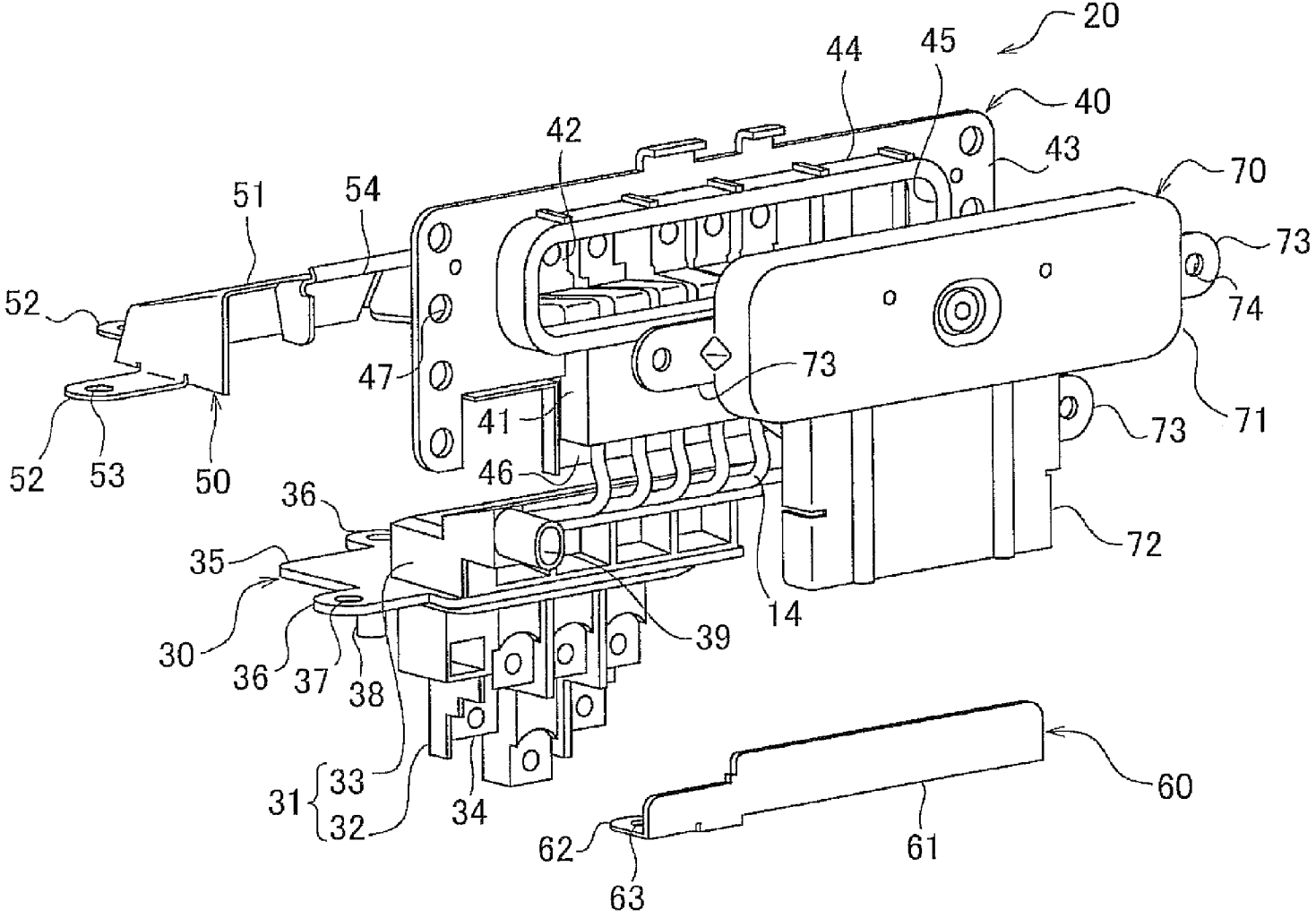
FIG. 3 is an exploded view of the shield structure shown in FIG. 2.

First of all, FIGS. 1 to 3 will be referred to. FIG. 1 schematically shows an essential part of the hybrid vehicle 10 that is equipped with the shield structure 20. FIG. 1 shows a state where respective cases 12 and 13 and respective metal shells 50, 60, and 70 have been cut along the vertical direction. Respective pedestals 35 and 43 are dotted for the sake of clarification of the drawing. FIG. 2 is a view showing the shield structure 20. FIG. 3 is an exploded view of the shield structure 20 (a view showing a state where the metal shells 50, 60, and 70 have been removed from terminal blocks 30 and 40).

The hybrid vehicle 10 is equipped with an engine (not shown), an MG1 that functions mainly as an electric generator, and an MG2 that functions mainly as an electric motor that assists the engine. The MG1 and the MG2 are rotating electrical machines. Further, the hybrid vehicle 10 is equipped with a battery (not shown) that supplies an electric power to the MG2 and the like, inverters 11 that carry out electric power conversion between the rotating electrical machines and the battery, and the like.

The hybrid vehicle 10 is equipped with a transaxle case 12 that accommodates the MG1 and the MG2, an inverter case 13 that accommodates the inverters 11, the terminal block 30 that is provided on the transaxle case 12, the terminal block 40 that is provided on the inverter case 13, conductor cables 14 that electrically connect the terminal block 30 and the terminal block 40 to each other, and the metal shells 50 and 70 that are arranged across the transaxle case 12 and the inverter case 13. Furthermore, the metal shell 60 that is fixed to the terminal block 30 is provided.

Although described later in detail, the shield structure 20 is composed of the terminal blocks 30 and 40, and the metal shells 50, 60, and 70 that are supported by the terminal blocks 30 and 40.

In addition to the MG1 and the MG2, for example, various gears (not shown) (a power split planetary gear, gears constituting a deceleration mechanism, namely, a counter gear and a final gear, and the like) and the like are accommodated in the transaxle case 12. These components are comprehensively referred to as a transaxle. Each of the MG1 and the MG2 is a three-phase synchronized rotating electrical machine that is composed of, for example, a rotor including a permanent magnet, and a stator including a U-phase stator coil, a V-phase stator coil, and a W-phase stator coil. Further, the transaxle case 12 has the terminal axle 30, which is electrically connected to the MG1 and the MG2. The terminal block 30 is provided, for example, on a top face of the transaxle case 12.

In addition to the inverters 11, for example, a converter (not shown) and a smoothing capacitor (not shown) are accommodated in the inverter case 13. These components are comprehensively referred to as a power control unit. Each of the inverters 11 is an electronic circuit including a switching element. In general, one of the inverters 11 is provided in a manner corresponding to the MG1, and the other inverter 11 is provided in a manner corresponding to the MG2. Further, the inverter case 13 has the terminal block 40, which is electrically connected to the inverter 11. The terminal block 40 is provided, for example, on a right face of the inverter case 13.

The transaxle case 12 and the inverter case 13 are arranged contiguous to each other. In the embodiment of the invention exemplified in FIG. 1, the inverter case 13 is arranged above the transaxle case 12. From the standpoint of space saving and the like, for example, the gap between the terminal block 30 and the inverter case 13 is set to about 5 to 10 cm.

The terminal block 30 has a connector 31 and a plate-like pedestal 35. The connector 31 electrically connects three MG1 terminals 17 and three MG2 terminals 18, which extend from the U-phase, V-phase, and W-phase of the MG1 and the MG 2 respectively, and six conductor cables 14 to one another. The connector 31 includes an MG connection portion 32 that is arranged on one face of the pedestal 35, a cable connection portion 33 that is arranged on the other face of the pedestal 35, and six terminal strips 34 that are provided over the MG connection portion 32 and the cable connection portion 33. Besides, each of the MG1 terminals 17 and the MG2 terminals 18 is connected to a corresponding one of the terminal strips 34 on one end side thereof, and each of the conductor cables 14 is connected to a corresponding one of the terminal strips 34 on the other end side thereof.

The terminal block 30 is mounted, for example, on the periphery of an opening portion 15 formed through the transaxle case 12, with the MG connection portion 32 inserted in the case, and with the cable connection portion 33 located outside the transaxle case 12. The pedestal 35 is configured by, for example, working a metal plate, and includes a flange portion 36 through which a bolt hole 37 is formed. The terminal block 30 is bolted to the transaxle case 12 with the aid of this flange portion 36. It should be noted that the flange portion 36 also functions as a fixation portion of the metal shell 50. Further, the terminal block 30 has a mounting pin 38 for fixing the metal shell 60, and a signal connector 39 for sending information on the rotational angles of the rotating electrical machines and the like to the outside.

The terminal block 40 has a connector 41, and a plate-like pedestal 43. The connector 41 includes six terminal strips 42 that electrically connect six inverter terminals 19 and the six conductor cables 14 to one another. The terminal strips 42 are introduced into the inverter case 13 through a pedestal opening portion 45 formed through the pedestal 43, and an opening portion 16 formed through the inverter case 13. Each of the conductor cables 14 is connected to a corresponding one of the terminal strips 42 on one end side thereof, and each of the inverter terminals 19 is connected to a corresponding one of the terminal strips 42 on the other end side thereof.

The terminal block 40 is mounted, for example, on the periphery of the opening portion 16, with the other end side of each of the terminal strips 42 inserted in the case. The pedestal 43 is configured by, for example, working a metal plate, and a bolt hole 47 is formed through the pedestal 43 at an end thereof. The terminal block 40 is bolted to the inverter case 13 with the aid of this bolt hole 47. It should be noted that the bolt hole 47 also functions as a fixation portion of the metal shell 70. Further, the terminal block 40 has a fitting portion 44 in which the metal shell 70 is fitted, and an engagement portion 46 with which the metal shell 50 is engaged.

As described above, the six conductor cables 14 are provided so as to correspond to the U-phase, V-phase, and W-phase of the MG1 and the MG2 respectively. The respective conductor cables 14 are arranged in line in the longitudinal direction. Since the transaxle case 12 and the inverter case 13 are arranged contiguous to each other, the conductor cables 14 have a short cable length (e.g., about 5 to 10 cm). The respective conductor cables 14 are all bent generally in the shape of L, and electrically connect the terminal block 30 and the terminal block 40 to each other.

Hereinafter, the configuration of the shield structure 20, namely, the terminal blocks 30 and 40 and the metal shells 50, 60, and 70 will be described in more detail.

The shield structure 20 is a structure for shielding magnetic fields generated from the conductor cables 14. Furthermore, the shield structure 20 also shields magnetic fields generated from connection regions between the conductor cables 14 and the terminal blocks 30 and 40 (i.e., the connectors 31 and 41). In the shield structure 20, the magnetic fields generated from the conductor cables 14 and the connection regions between the conductor cables 14 and the terminal blocks 30 and 40 are counterbalanced by the plurality of the metal shells 50, 60, and 70, which are supported by at least one of the terminal blocks 30 and 40, so that electromagnetic noise is suppressed.

The metal shell 50 is arranged in such a manner as to cover parts (left sides) of the peripheries of the conductor cables 14 along the direction in which the respective conductor cables 14 are aligned (the longitudinal direction), and the cable connection portion 33 as the connection region between the conductor cables 14 and the terminal block 30. The metal shell 50 has a shell body 51 that is worked in accordance with the shape of the cable connection portion 33. The shell body 51 includes a top face portion, a left face portion, a front face portion, and a rear face portion, which cover a top face, a left face, a front face, and a rear face of the cable connection portion 33 respectively. That is, the metal shell 50 assumes a shape that allows the faces other than a right face, from which the conductor cables 14 of the cable connection portion 33 are drawn out, and a bottom face, which is oriented toward the transaxle case 12 side, to be covered.

The metal shell 50 has a flange portion 52 that extends from the shell body 51. The flange portion 52 extends, for example, forward and leftward from a lower end of the shell body 51. The flange portion 52 is formed at such a position as to overlap with the flange portion 36 of the terminal block 30, and includes a bolt hole 53 that coincides in position with the bolt hole 37 of the flange portion 36. That is, the metal shell 50 is fixed, together with the terminal block 30, to the transaxle case 12 by a bolt (not shown) that is inserted through the bolt hole 37 and the bolt hole 53 after arranging the flange portion 52 in such a manner as to overlap with the flange portion 36.

The metal shell 50 has an engagement strip 54 that extends from the shell body 51. The engagement strip 54 extends, for example, upward from a right end of a top face portion of the shell body 51. The engagement strip 54 is inserted into the engagement portion 46, which is provided between the conductor cables 14 and the pedestal 43, and is engaged with the terminal block 40, below the connector 41.

As described above, the metal shell 50 is bolted to the terminal block 30 (the transaxle case 12), is engaged with the terminal block 40, and is supported by both the terminal blocks 30 and 40. That is, the terminal blocks 30 and 40 have support portions that support the metal shell 50. Thus, the metal shell 50 is arranged across the terminal block 30 and the terminal block 40.

The metal shell 60 is arranged in such a manner as to cover a lower portion of a right face of the cable connection portion 33, and to extend around part of a bottom face of the cable connection portion 33, below the conductor cables 14. The metal shell 60 has a shell body 61 that is bent generally in the shape of L. The shell body 61 assumes a partially cut shape so as to circumvent the signal connector 39.

The metal shell 60 has a flange portion 62 that extends from the shell body 61. The flange portion 62 assumes, for example, a shape extending in the lateral direction. Further, a pin insertion hole 63 is formed through the flange portion 62. Besides, the flange portion 62 is arranged such that the mounting pin 38 is inserted in the pin insertion hole 63, and is supported on the terminal block 30 by the mounting pin 38.

The metal shell 70 is arranged in such a manner as to cover parts (a right side) of the peripheries of the conductor cables 14 along the direction in which the respective conductor cables 14 are aligned (the longitudinal direction), and to cover the connector 41 as a connection region between the conductor cables 14 and the terminal block 40. The metal shell 70 has a first shell body 71 that is fitted in the fitting portion 44, and a second shell body 72 that covers the conductor cables 14 and the connector 41. The fitting portion 44 is an annular convex portion that is formed around the pedestal opening portion 45. The first shell body 71 is worked in accordance with the shape of the fitting portion 44. The second shell body 72 covers regions in front of, behind, and below rows of the respective conductor cables 14. The second shell body 72 assumes, in the vicinity of a lower end thereof, a shape that allows the second shell body 72 to abut on the metal shell 60.

The metal shell 70 has flange portions 73 that extend from the first shell body 71 and the second shell body 72 respectively. For example, two of the flange portions 73 are provided on the first shell body 71, and the other flange portion 73 is provided on the second shell body 72. All the flange portions 73 extend in the longitudinal direction. Besides, a bolt hole 74 that coincides in position with the bolt hole 47 is formed through the flange portion 73. That is, the metal shell 70 is fixed, together with the terminal block 40, to the inverter case 13 by a bolt (not shown) that is inserted through the bolt hole 47 and the bolt hole 74.

As described above, the metal shell 70 is bolted to the terminal block 40 (the inverter case 13), and is arranged in such a manner as to abut on the metal shell 60, which covers the cable connection portion 33. Thus, the metal shell 70 is arranged across the terminal block 30 and the terminal block 40. It should be noted that the metal shell 60 and the metal shell 70 may be joined to each other through welding or the like.

As described above, in the shield structure 20, the plurality of the metal shells 50, 60, and 70 cover the peripheries of the conductor cables 14, and the connection regions between the conductor cables 14 and the terminal blocks 30 and 40. Also, the metal shells 50 and 70 are arranged across the terminal block 30 and the terminal block 40. Thus, magnetic fields generated from the conductor cables 14, and magnetic fields generated from the connection regions between the conductor cables 14 and the terminal blocks 30 and 40 are unlikely to leak out, and good shield performance can be exerted.

Further, the terminal blocks 30 and 40 are provided with the support portions such as the flange portion 36, the fitting portion 44, the engagement portion 46, and the like. For example, the metal shell 50 is bolted, together with the terminal block 30, to the transaxle case 12 with the aid of the flange portion 36. Thus, the metal shells 50, 60, and 70 can also be mounted with ease in a narrow space between the transaxle case 12 and the inverter case 13.

The foregoing embodiment of the invention can be varied in design without losing sight of the object of the invention. Design variation examples (modification examples) will be illustrated hereinafter with reference to FIGS. 4 to 6. Those component elements which are the same as in the foregoing embodiment of the invention will be denoted by the same reference symbols respectively, and the same description as above will be omitted.

Figure 4:
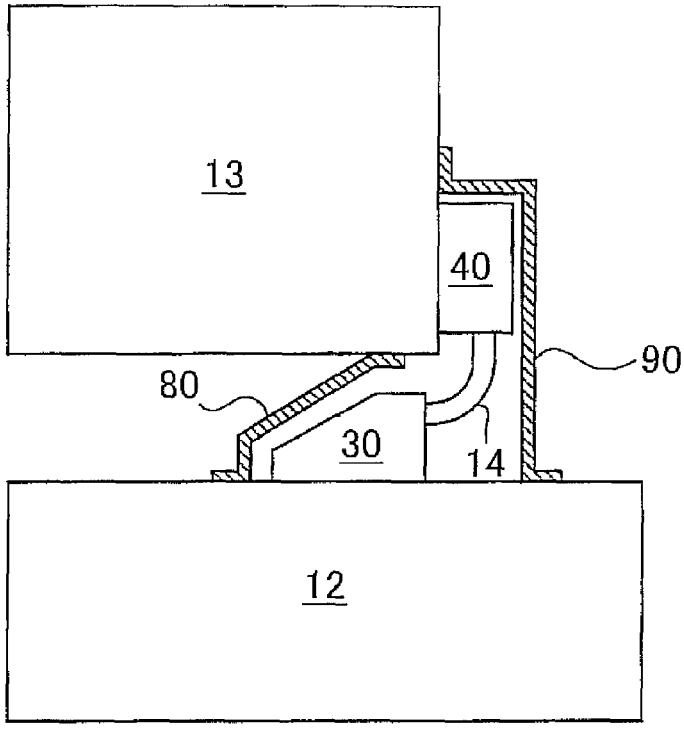
FIG. 4 is a view schematically showing another embodiment of the invention.
Figure 5:
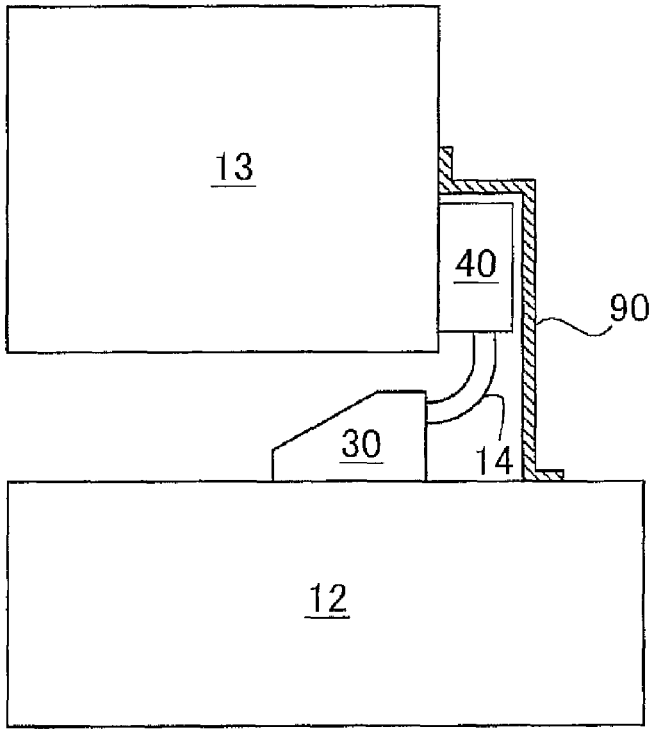
FIG. 5 is a view schematically showing still another embodiment of the invention.
Figure 6:
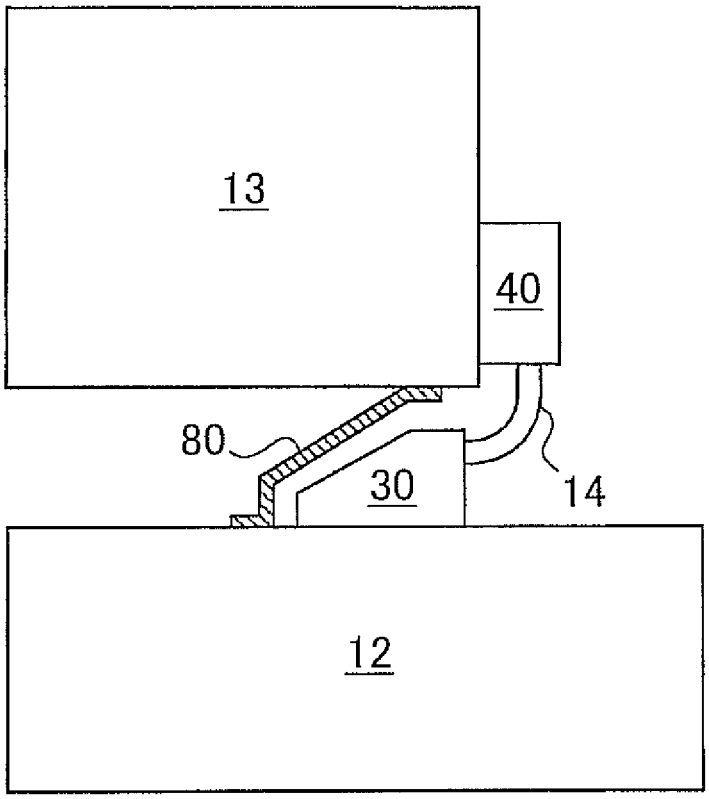
FIG. 6 is a view schematically showing still another embodiment of the invention.

FIGS. 4 to 6 are views obtained by simplifying FIG. 1, and show shield structures as modification examples of the foregoing embodiment of the invention respectively. In the embodiment of the invention exemplified in FIG. 4, metal shells 80 and 90 cover the conductor cables 14, the terminal block 30, and the terminal block 40. The metal shells 80 and 90 are arranged contiguous to the conductor cables 14 and the like. Therefore, a current flows through the metal shells 80 and 90 in the direction opposite to a current flowing through the conductor cables 14, and counterbalances magnetic fields generated from the conductor cables 14 and the like to suppress electromagnetic noise. It should be noted that both the metal shells 80 and 90 are arranged over the transaxle case 12 and the inverter case 13, and are directly fixed to the cases respectively.

In the embodiment of the invention exemplified in FIG. 5, only the metal shell 90 is provided. In the embodiment of the invention exemplified in FIG. 6, only the metal shell 80 is provided. In these embodiments of the invention as well, it is possible to counterbalance magnetic fields generated from the conductor cables 14 and the like and suppress electromagnetic noise, by arranging the metal shell 80 and/or the metal shell 90 contiguous to the conductor cables 14 and the like.

What is claimed is:

1. A shield structure of a conductor cable, comprising:

a first case that accommodates a rotating electrical machine;

a first terminal block that is provided on the first case;

a second case that accommodates an inverter;

a second terminal block that is provided on the second case;

a conductor cable that electrically connects the first terminal block and the second terminal block to each other; and a metal shell that is arranged across the first case and the second case, the metal shell covers at least part of a periphery of the conductor cable, the metal shell is configured to include a first metal shell and a second metal shell, the first metal shell is arranged in such a manner so as to cover a first side of the conductor cable, the first metal shell is fixed to the first case by a bolt, the first metal shell is supported by the second case, the second metal shell is arranged in such a manner so as to cover an opposite second side of the conductor cable, the second metal shell is fixed to the second case by a bolt, and the second metal shell is supported by the first case.

2. The shield structure according to claim 1, wherein the metal shell is further configured to include a third shell, the third metal shell is arranged in such a manner so as to cover a lower portion of a first face of a cable connection portion, and the third metal shell is supported by the first case, the second metal shell is supported by the first case through the third metal shell.

3. The shield structure according to claim 1, wherein the metal shell is arranged in such a manner as to cover at least one of the first terminal block and the second terminal block.

4. An electrically driven vehicle comprising:

a first case that accommodates a rotating electrical machine;

a second case that accommodates an inverter;

a first terminal block that is provided on the first case;

a second terminal block that is provided on the second case;

a conductor cable that electrically connects the first terminal block and the second terminal block to each other; and a metal shell that is arranged across the first case and the second case, the metal shell covers at least part of a periphery of the conductor cable, the metal shell configured to include a first metal shell and a second metal shell, the first metal shell is arranged in such a manner so as to cover a first side of the conductor cable, the first metal shell is fixed to the first case by a bolt, the first metal shell is supported by the second case, the second metal shell is arranged in such a manner so as to cover an opposite second side of the conductor cable, the second metal shell is fixed to the second case by a bolt, and the second metal shell is supported by the first case.

* * * * *